US005971232A

United States Patent [19]

Rohr et al.

[11] Patent Number: 5,971,232

[45] Date of Patent: Oct. 26, 1999

[54] DISPENSING STRUCTURE WHICH HAS A PRESSURE-OPENABLE VALVE RETAINED WITH FOLDING ELEMENTS

[75] Inventors: Robert D. Rohr, Eagle; Milton R. Dallas, Jr., East Troy; Thomas P. Kasting, Eagle, all of Wis.

[73] Assignee: AptarGroup, Inc., Crystal Lake, Ill.

[21] Appl. No.: 09/089,573

[22] Filed: Jun. 3, 1998

[51] Int. Cl.[6] ..... B65D 5/72; B65D 43/16; B65D 39/00

[52] U.S. Cl. ..... 222/494; 222/213; 222/490; 220/259; 215/294

[58] Field of Search ..... 222/490, 494, 222/212, 213; 220/259; 215/294, 306

[56] References Cited

U.S. PATENT DOCUMENTS

| | | | |
|---|---|---|---|
| 3,279,643 | 10/1966 | Amesbury et al. | 220/24.5 |
| 3,337,900 | 8/1967 | Schwartzman . | |
| 3,578,203 | 5/1971 | Mainet | 220/46 |
| 3,877,598 | 4/1975 | Hazard . | |
| 3,981,419 | 9/1976 | Nilson . | |
| 4,010,875 | 3/1977 | Babiol . | |
| 4,185,747 | 1/1980 | Goncalves . | |
| 4,231,486 | 11/1980 | Bock . | |
| 4,420,101 | 12/1983 | O'Neill . | |
| 4,506,809 | 3/1985 | Corsette . | |
| 4,519,513 | 5/1985 | Weiler et al. . | |
| 4,722,449 | 2/1988 | Dubach . | |
| 4,739,906 | 4/1988 | LoTurco . | |
| 4,746,025 | 5/1988 | Krautkrämer et al. . | |
| 4,779,764 | 10/1988 | Debetencourt . | |
| 4,785,978 | 11/1988 | Kano et al. . | |
| 4,793,501 | 12/1988 | Beck . | |
| 4,796,769 | 1/1989 | Obadia . | |
| 4,807,769 | 2/1989 | Gach . | |
| 4,811,856 | 3/1989 | Fischman . | |
| 4,813,577 | 3/1989 | Carow . | |
| 4,848,612 | 7/1989 | Beck . | |
| 4,917,271 | 4/1990 | Kanner et al. . | |
| 4,941,580 | 7/1990 | Julian . | |
| 4,941,598 | 7/1990 | Lambelet, Jr. et al. . | |
| 4,991,745 | 2/1991 | Brown . | |
| 4,993,577 | 2/1991 | Griffin et al. . | |
| 4,993,606 | 2/1991 | Bolen et al. . | |
| 5,005,737 | 4/1991 | Rohr . | |
| 5,033,647 | 7/1991 | Smith et al. . | |
| 5,048,750 | 9/1991 | Tobler . | |
| 5,094,361 | 3/1992 | Dubach . | |

(List continued on next page.)

*Primary Examiner*—Andres Kashnikow
*Assistant Examiner*—Keats Quinalty
*Attorney, Agent, or Firm*—Rockey, Milnamow & Katz, Ltd.

[57] ABSTRACT

A system is provided for holding a dispensing valve that has a peripheral mounting flange and that is operable to discharge the contents from the interior of a container. The system includes a body for extending from the container. The body has a seat for engaging part of the valve mounting flange. The body has a resilient hinge and a protrusion that (1) extends from the hinge, and (2) has an abutment surface. The system includes a retainer for mounting to the body. The retainer has a seat for engaging part of the valve mounting flange. The retainer has a resilient hinge and an engaging member that (1) extends from the retainer hinge, and (2) has an abutment surface. The hinges accommodate deflection of the protrusion and engaging member as the protrusion and engaging member move past each other and establish abutting engagement of the protrusion abutment surface with the engaging member abutment surface as relative movement is effected between the body and retainer so as to clamp the valve mounting flange between the body seat and retainer seat.

16 Claims, 7 Drawing Sheets

U.S. PATENT DOCUMENTS

| | | | |
|---|---|---|---|
| 5,115,950 | 5/1992 | Rohr | 222/490 |
| 5,125,539 | 6/1992 | Schneider . | |
| 5,145,646 | 9/1992 | Tyranski . | |
| 5,161,718 | 11/1992 | Gueret . | |
| 5,169,035 | 12/1992 | Imbery, Jr. . | |
| 5,203,838 | 4/1993 | Schneider . | |
| 5,226,568 | 7/1993 | Newton et al. . | |
| 5,271,531 | 12/1993 | Rohr et al. | 222/212 |
| 5,275,312 | 1/1994 | Labruzzo . | |
| 5,305,900 | 4/1994 | Maguire et al. . | |
| 5,335,802 | 8/1994 | Brach et al. . | |
| 5,339,972 | 8/1994 | Crosnier et al. . | |
| 5,377,877 | 1/1995 | Brown et al. . | |
| 5,390,805 | 2/1995 | Bilani et al. . | |
| 5,409,144 | 4/1995 | Brown . | |
| 5,454,489 | 10/1995 | Vesborg . | |
| 5,454,494 | 10/1995 | Lechelle . | |
| 5,531,363 | 7/1996 | Gross et al. . | |
| 5,577,625 | 11/1996 | Baird et al. . | |
| 5,626,262 | 5/1997 | Fitten et al. . | |
| 5,632,420 | 5/1997 | Lohrman et al. . | |
| 5,676,289 | 10/1997 | Gross et al. . | |
| 5,680,969 | 10/1997 | Gross . | |
| 5,743,443 | 4/1998 | Hins . | |
| 5,769,253 | 6/1998 | Gross . | |
| 5,782,386 | 7/1998 | Lester . | |

DISPENSING STRUCTURE WHICH HAS A PRESSURE-OPENABLE VALVE RETAINED WITH FOLDING ELEMENTS

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a system for dispensing a product from a container. This invention is more particularly related to a system incorporating a dispensing valve which is especially suitable for use with a squeeze-type container wherein a product can be discharged from the container through the valve when the container is squeezed.

BACKGROUND OF THE INVENTION AND TECHNICAL PROBLEMS POSED BY THE PRIOR ART

A variety of packages, including dispensing packages or containers, have been developed for personal care products such as shampoo, lotion, etc., as well as for other materials. Such containers typically have a neck defining an open upper end on which is mounted a dispensing closure.

One type of dispensing closure for these kinds of containers has a flexible, pressure-openable, self-sealing, slit-type dispensing valve mounted in the closure over the container opening. When the container is squeezed, the valve slits open, and the fluid contents of the container are discharged through the open slits of the valve. The valve automatically closes to shut off fluid flow therethrough upon removal of the increased pressure—even if the container is inverted so that the valve is subjected to the weight of the contents within the container.

Designs of closures using such valves are illustrated in the U.S. Pat. Nos. 5,271,531 and 5,033,655. Typically, the closure includes a body mounted on the container neck to hold the valve over the container opening.

A lid can be provided for covering the valve during shipping and when the container is otherwise not in use. See, for example, FIGS. 31–34 of U.S. Pat. No. 5,271,531. Such a lid can be designed to prevent leakage from the valve under certain conditions. The lid can also keep dust and dirt from the valve and/or can protect the valve from damage.

In some designs for closures incorporating a flexible, pressure-openable, self-sealing, slit-type dispensing valve, the valve is retained within a closure body by means of a separate retainer piece which is snap-fit into the closure body to engage one side of a peripheral flange of the valve and clamp the valve flange against the closure body. Such snap-fit retention systems typically employ an undercut configuration on the closure body and/or retainer piece to provide the snap-fit engagement. While such undercut configurations generally function satisfactorily, it would be desirable to provide an improved system for securing the valve.

In particular, it would be desirable to provide a valve retention system that would be robust enough to better withstand loads imposed during the manufacture and assembly of the components. Such an improved system should preferably accommodate tolerances and variations in the component dimensions and also accommodate slight misalignments of the components during assembly.

Advantageously, such an improved system should also accommodate molding of the components from a variety of thermoplastic materials in a way that will tolerate some amount of manufacturing process imperfections, including molding cavitation.

Further, such an improved system should also preferably accommodate the application of torque as well as other loads that may be imposed during the use of the completed product or during the manufacture and assembly of the product.

Such an improved system should also accommodate dispensing structure designs which permit incorporation of the dispensing structure as a unitary part, or extension, of the container and which also accommodate designs that separately mount the dispensing structure on the container in a secure manner.

Further, it would be desirable if such an improved system could be provided in a dispensing structure that would accommodate efficient, high-quality, large volume manufacturing techniques with a reduced product reject rate.

Preferably, the improved dispensing structure should also accommodate high-speed manufacturing techniques that produce products having consistent operating characteristics unit-to-unit with high reliability.

The present invention provides an improved valve retention system and dispensing structure which can accommodate designs having the above-discussed benefits and features.

SUMMARY OF THE INVENTION

According to one aspect of the present invention, a system is provided for holding a dispensing valve that has a peripheral mounting flange and that is operable to discharge the contents from the interior of the container. The system includes a body for extending from the container. The body has a seat for engaging part of the valve mounting flange. The body has a resilient hinge and has a protrusion that (1) extends from the hinge, and (2) defines an abutment surface.

In a preferred embodiment, the body defines a dispensing passage for establishing communication between the interior of the container and the exterior of the container, and the body defines a first seat around the dispensing passage for engaging a first side of the valve mounting flange. The body has a body wall around the first seat, and the protrusion extends from the body wall. The protrusion has a distal end defining the abutment surface, and the protrusion is connected to the body wall with the resilient hinge having an unstressed (as-molded) condition which initially maintains the protrusion in an orientation extending relative to the dispensing passage at an oblique angle.

The system also includes a retainer for mounting to the body. The retainer has a seat for engaging part of the valve mounting flange. The retainer has a resilient hinge and has an engaging member that (1) extends from the retainer hinge, and (2) defines an abutment surface.

In a preferred embodiment, the retainer defines an aperture for communicating with the body dispensing passage, and the retainer defines a second seat around the aperture for engaging a second side of the valve mounting flange. The retainer has a retainer wall around the second seat, and the engaging member extends from the retainer wall. The retainer engaging member has a distal end that defines the abutment surface, and the engaging member is connected to the retainer wall with the resilient hinge. The resilient hinge has an unstressed (as-molded) condition which initially maintains the engaging member in an orientation extending outwardly away from the aperture at an oblique angle.

The hinges on the body and on the retainer accommodate deflection of the protrusion and of the engaging member as the protrusion and engaging member move past each other and establish abutting engagement of the protrusion abutment surface with the engaging member abutment surface when relative movement is effected between the body and retainer to clamp the valve mounting flange between the body seat and the retainer seat.

Numerous other advantages and features of the present invention will become readily apparent from the following detailed description of the invention, from the claims, and from the accompanying drawing.

BRIEF DESCRIPTION OF THE DRAWINGS

In the accompanying drawings that form part of the specification, and in which like numerals are employed to designate like parts throughout the same.

FIG. 14 shows a stage in the assembly of the retainer onto the body in which the valve is seated.

DESCRIPTION OF THE PREFERRED EMBODIMENT

Figure 1:
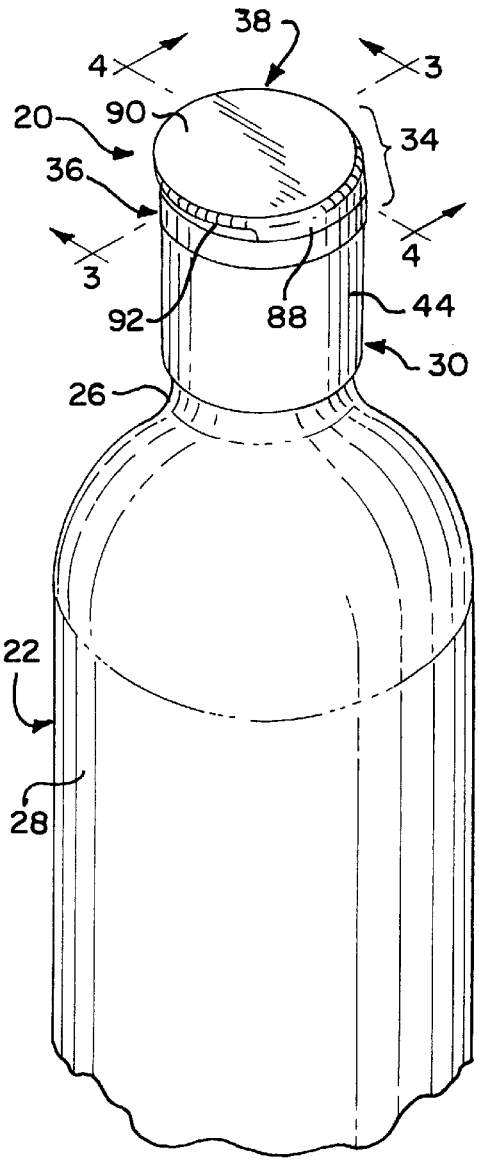
FIG. 1 is a fragmentary, perspective view of a system of the present invention in the form of a dispensing closure which incorporates a flexible valve having self-sealing slits which open to permit flow therethrough in response to increased pressure on the side of the valve facing the container interior when the closure is mounted on the container.

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the dispensing structure of this invention is described in various operating positions. It will be understood, however, that the dispensing structure of this invention may be manufactured, stored, transported, used, and sold in orientations other than the positions described.

One presently preferred embodiment of the dispensing structure of the present invention is illustrated in the figures in the form of a dispensing closure designated generally by the reference number 20. The dispensing structure or closure 20 is provided as a separately manufactured unit for mounting to the top of a container 22. It will be appreciated, however, that it is contemplated that in some applications it may be desirable for the dispensing structure 20 to be formed as a unitary part, or extension, of the container 22.

The container 22 typically has a conventional mouth or opening 24 (FIG. 3) which provides access to the container interior and product contained therein. The product may be, for example, a liquid comestible product. The product could also be any other solid, liquid, or gaseous substance, including, but not limited to, a food product, a personal care product, an industrial or household cleaning product, a paint product, a wall patch product, or other chemical compositions (e.g., for use in activities involving manufacturing, commercial or household maintenance, construction, remodeling, and agriculture), etc.

The container may typically have a neck 26 (FIG. 3) or other suitable structure extending from a hollow body 28 and defining the container mouth or opening 24. The container neck 26 may have (but need not have) a circular cross-sectional configuration, and the body 28 of the container 22 may have another cross-sectional configuration, such as an oval cross-sectional shape, for example. The container 22 may, on the other hand, have a substantially uniform shape along its entire length or height without any neck portion of reduced size or different cross-section.

The container 22 may typically be a squeezable container having a flexible wall or walls which can be grasped by the user and compressed to increase the internal pressure within the container so as to squeeze the product out of the container through the closure 20 when the closure 20 is open. Such a container wall typically has sufficient, inherent resiliency so that when the squeezing forces are removed, the container wall returns to its normal, unstressed shape. Such a structure is preferred in many applications, but may not be necessary or preferred in other applications. Indeed, the container may be substantially rigid. A piston could be provided in such a rigid container to aid in dispensing a product, especially a relatively viscous product.

Figure 2:
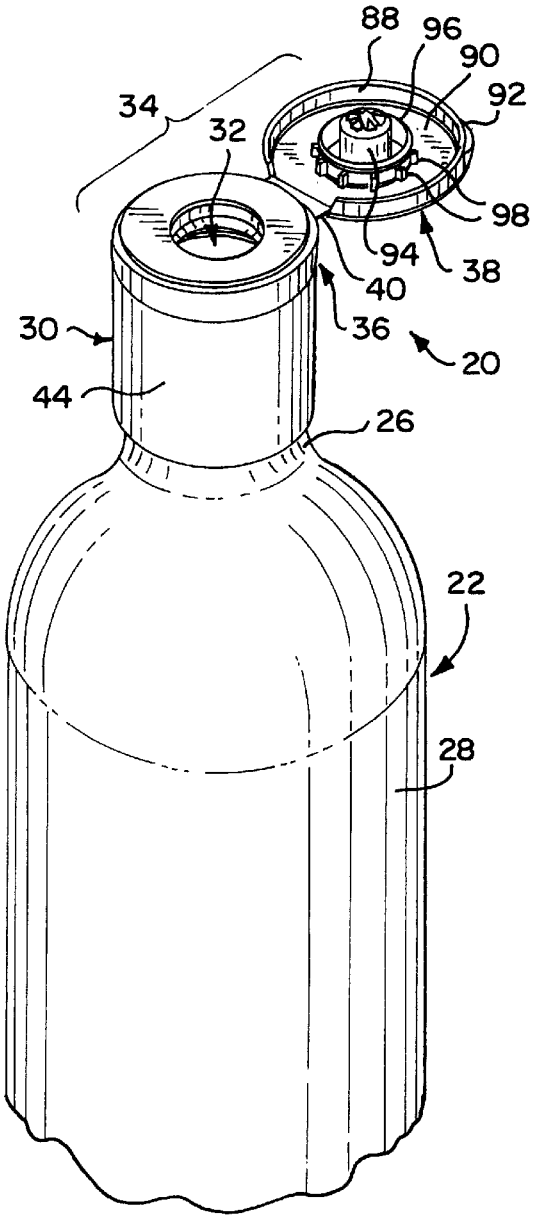
FIG. 2 is a view similar to FIG. 1, but FIG. 2 shows the closure with the lid in an open position.
Figure 3:
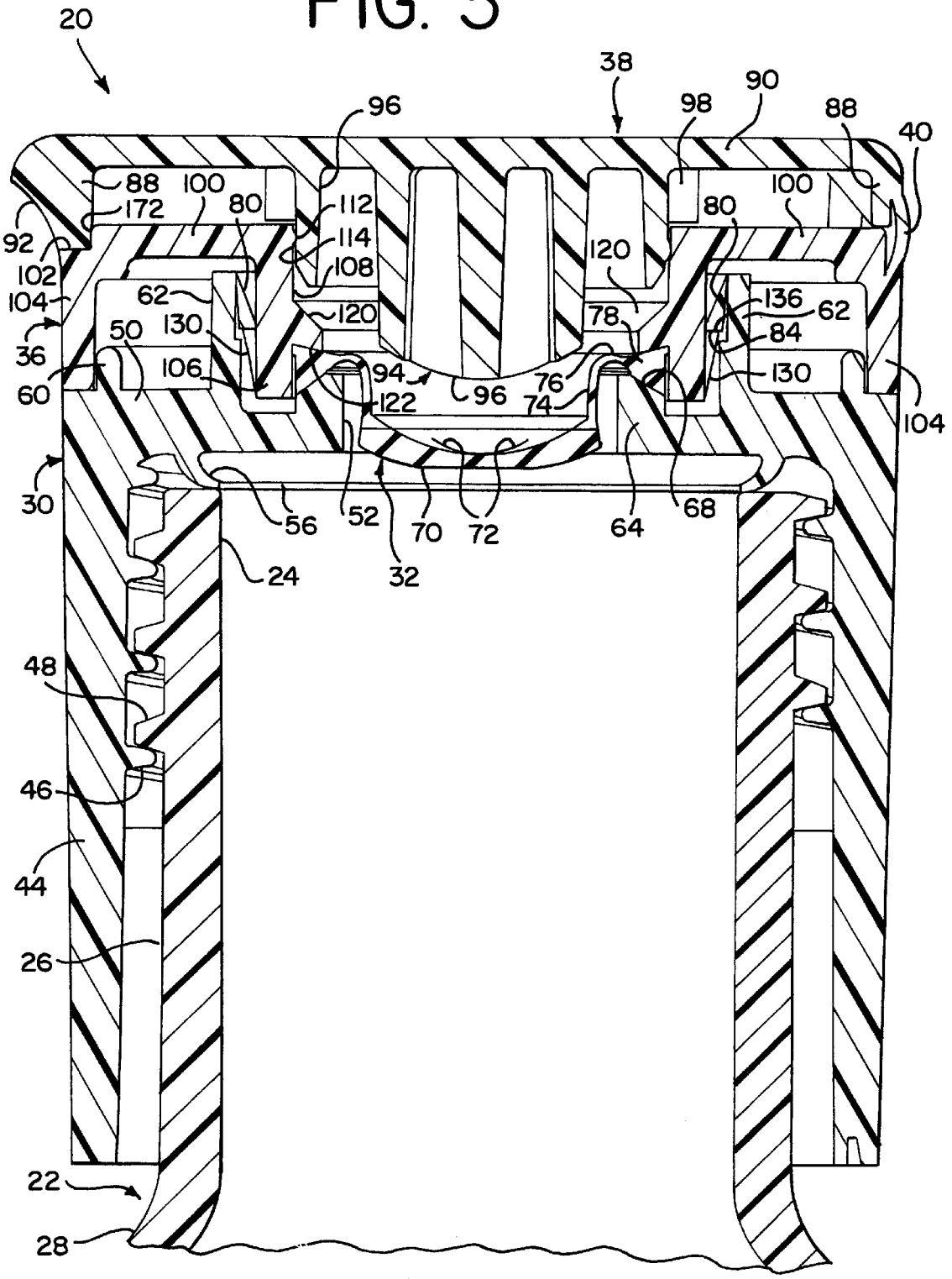
FIG. 3 is a greatly enlarged, fragmentary, cross-sectional view taken generally along the plane 3—3 in FIG. 1.

As shown in FIGS. 2 and 3, the dispensing structure or closure 20 includes a receiver or body 30 in which is disposed a valve 32. The closure 20 also includes a retainer 34 holding the valve 32 in the receiver or body 30. The retainer 34 includes (1) a base 36 for seating on the closure body 30, (2) a lid 38, and (3) a hinge 40 connecting the lid 38 with the base 36.

As shown in FIG. 3, the closure body 30 defines a skirt 44 which has a conventional thread 46 for engaging a thread 48 on the container neck 26 to secure the closure body 30 to the neck 26 of the container 22.

The closure body 30 and container 22 could also be releasably attached with a snap-fit bead and groove, or by other means. Alternatively, the closure body 30 may be permanently attached to the container by means of a suitable snap-fit, or by means of induction melting, ultrasonic melting, gluing, or the like, depending upon the materials employed for the container and closure. Further, the closure 20 could, in some applications, be formed as a unitary part, or extension, of the container 22.

Figure 9:
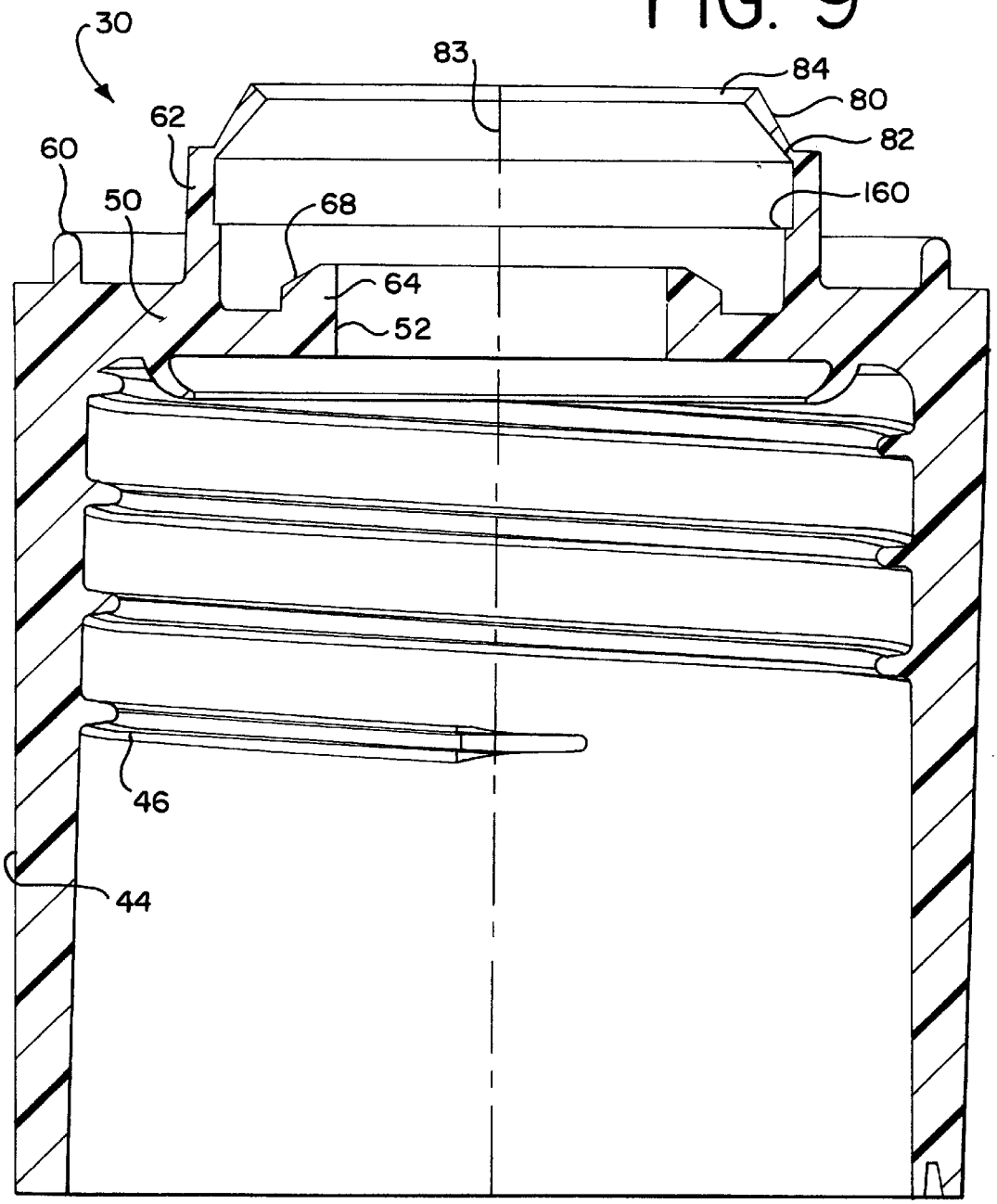
FIG. 9 is a greatly enlarged, cross-sectional view taken generally along the plane 9—9 in FIG. 8.
Figure 10:
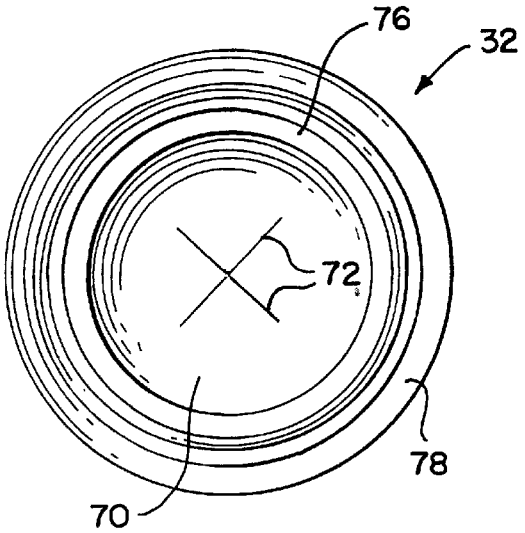
FIG. 10 is top plan view of the flexible, pressure-openable, self-sealing, slit-type dispensing valve in the as-molded condition prior to assembly with the body and retainer.
Figure 11:
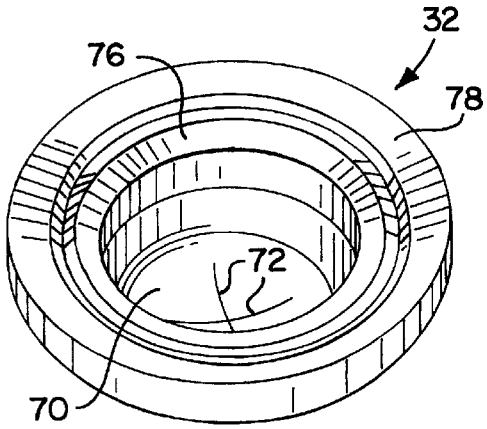
FIG. 11 is a perspective view of the valve.
Figure 12:
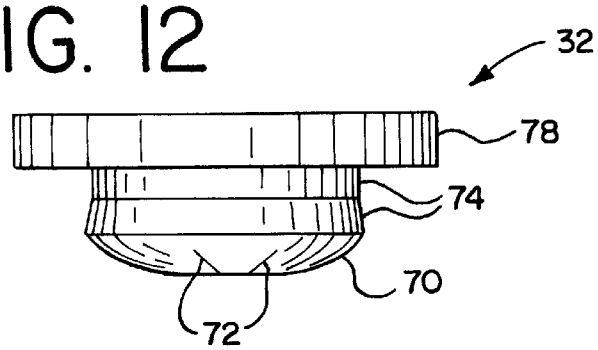
FIG. 12 is a side elevation view of the valve.

As shown in FIGS. 3 and 9, the top of the closure skirt 44, the closure body 30 defines a deck 50 defining a dispensing passage 52 for establishing communication between the container interior and exterior. Preferably, as shown in FIG. 3, an annular, flexible "crab's claw" shaped seal 56 projects from the lower surface of the closure body deck 50 adjacent the upper end of the container neck 26 so as to provide a leak-tight seal between the closure body 30 and the container neck 26. Of course, other types of closure body/container seals may be employed.

Projecting upwardly from the upper surface of the closure body deck 50 is an outer annular rim 60 (FIGS. 3 and 9). Within the rim 60, and concentric therewith, is an upwardly projecting, annular wall 62 (FIGS. 3 and 9). Inwardly of the annular wall 62, and concentric therewith, is an annular seating wall 64 (FIGS. 3 and 9). The seating wall 64 has an interior, cylindrical surface defining the dispensing passage 52, and the top of the seating wall 64 defines a first seat 68 (FIGS. 3 and 9). The first seat 68 defines a frustoconical surface for receiving a peripheral portion of the valve 32 (FIG. 3).

The valve 32 is of a known design employing a flexible, resilient material which can open to dispense product. The valve 32 is molded from silicone. The valve 32 may also be molded from thermosetting elastomeric materials, such as natural rubber and the like, or thermoplastic elastomers based upon materials such as thermoplastic propylene, ethylene, urethane, and styrene, including their halogenated counterparts.

A valve which is similar to, and functionally analogous to, valve 32 is disclosed in the U.S. Pat. No. 5,439,143. However, the valve 32 has a peripheral flange structure (described in detail hereinafter) which differs from the flange structure of the valve shown in the U.S. Pat. No. 5,439,143. The description of the valve disclosed in the U.S. Pat. No. 5,439,143 is incorporated herein by reference to the extent pertinent and to the extent not inconsistent herewith.

As illustrated in FIGS. 3 and 10–12, the valve 32 includes a flexible, central portion, wall, or face 70 which has a concave configuration (when viewed from the exterior) and which defines two, mutually perpendicular, intersecting dispensing slits 72 of equal length. The intersecting slits 72 define four, generally sector-shaped, flaps or petals in the concave, central wall 70. The flaps open outwardly from the intersection point of the slits 72, in response to increasing container pressure of sufficient magnitude, in the well-known manner described in the U.S. Pat. No. 5,439,143.

The valve 32 includes a skirt 74 (FIGS. 3 and 12) which extends outwardly from the valve central wall or face 70. At the outer (upper) end of the skirt 74 there is a thin, annular flange 76 which extends peripherally from the skirt 74 in an angled orientation. The thin flange 76 terminates in an enlarged, much thicker, peripheral flange 78 which has a generally dovetail shaped transverse cross section.

To accommodate the seating of the valve 32 in the body 30, the surface of the closure body seat 68 has the same angle as the angle of the valve flange dovetail configuration. This permits the bottom surface of the valve flange 78 to be disposed on, and clamped tightly against, the closure body seat 68.

The valve 32 is held in position within the closure 20 by means of a unique engaging relationship established between the closure body 30 and the retainer 34. The retention system permits the valve 32, the closure body 30, and the retainer 34 to each be separately molded and then subsequently assembled. The closure body 30 and retainer 34 are each molded with projecting elements having an initial, disengaged configuration, and during subsequent assembly, the elements are forced into a final, engaging configuration.

Figure 8:
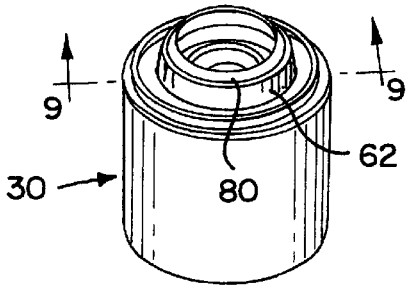
FIG. 8 is a perspective view of the body in the as-molded condition prior to assembly with the valve and retainer.

In particular, a primary structure of the closure body 30 that engages the retainer 34 is a protrusion 80 (FIGS. 8 and 9) that is formed as a unitary part, or extension, of the closure body annular wall 62. As shown in FIGS. 8 and 9, the protrusion 80 is molded as a generally annular, upwardly projecting extension of the annular wall 62. The lower portion of the protrusion 80 is connected to the top of the annular wall 62 with a reduced-cross section thickness of material defining a resilient hinge 82.

As can be seen in FIG. 9, the cross-sectional shape of the protrusion 80 is not uniform. Rather, the thickness of the protrusion 80 increases from a minimum at the hinge 82 to a maximum at the upper, distal end which defines an abutment surface 84. The exterior surface of the protrusion 80 defines a frustum of a cone with the smaller diameter being defined at the top, distal end along the abutment surface 84 and with the larger diameter being defined along the bottom of the protrusion along the hinge 82. The hinge 82 is a resilient hinge having an as-molded, unstressed condition to initially maintain the protrusion 80 in an orientation extending toward the axis 83 of the dispensing passage at an oblique angle as shown in FIG. 9.

Figure 5:
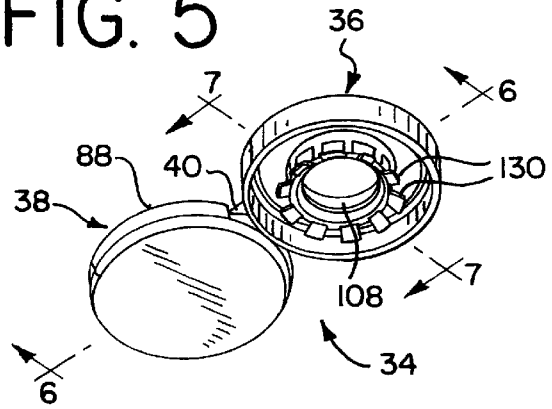
FIG. 5 is a perspective view of the retainer shown in an as-molded condition with the lid open and prior to assembly on the body.
Figure 6:
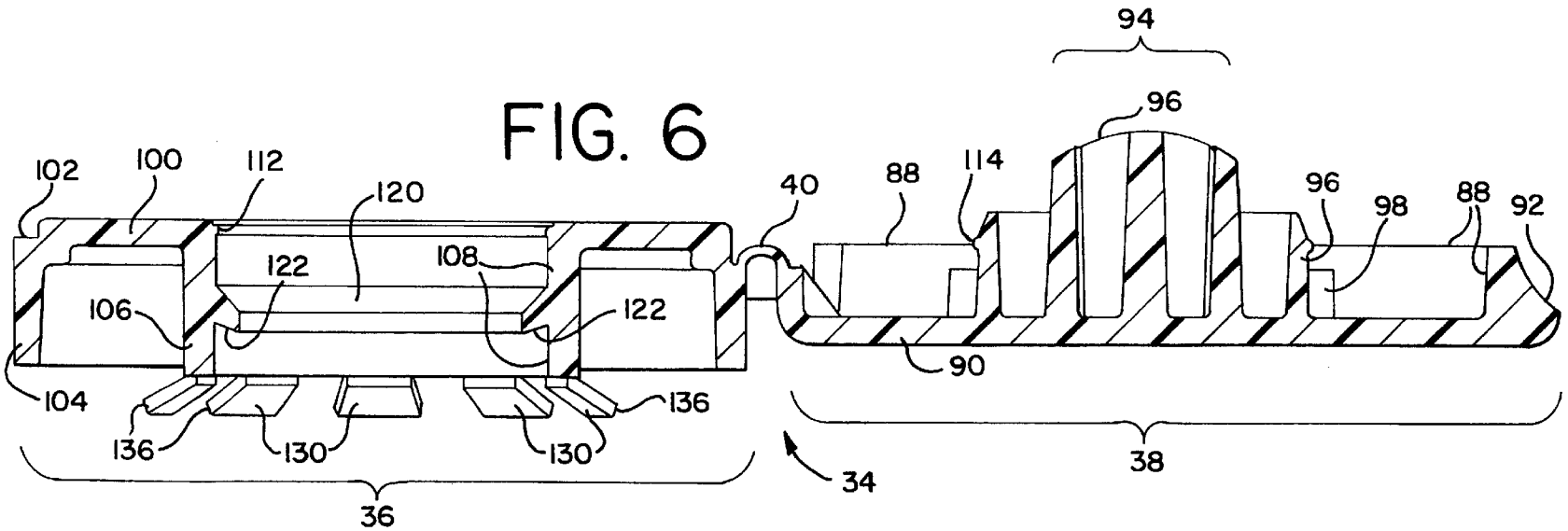
FIG. 6 is a greatly enlarged, cross-sectional view taken generally along the plane 6—6 in FIG. 5.

The retainer 34 is initially molded as shown in FIGS. 5–6. The retainer 34 is molded with the lid 38 in an open position relative to the base 36.

The hinge 40 is a snap-action hinge formed integrally with the lid 38 and base 36 in a unitary structure. The illustrated snap-action hinge 40 is a conventional type as described in U.S. Pat. No. 5,642,824. The snap-action hinge readily maintains the lid 38 in the open position during the dispensing of the container contents at the application site.

The lid includes a skirt 88 (FIGS. 5 and 6) which depends from the periphery of a circular top wall or cover 90. 180 degrees from the hinge 40, a portion of the skirt 88 and top wall 90 project outwardly to define an overhang 92 which serves as a surface against which a thumb or finger may be pressed in order to assist in lifting the lid 38 away from the closed position on the base 36.

Projecting outwardly from the lid cover or top wall 90 is a partly hollow post 94 which has a curved end surface or convex distal end surface 96. Surrounding the post 94, and projecting outwardly from the lid wall 90, is a ring or collar 96. Ribs 98 extend along the lower, exterior portion of the collar 96 and an adjacent portion of the lid wall 90.

Figure 4:
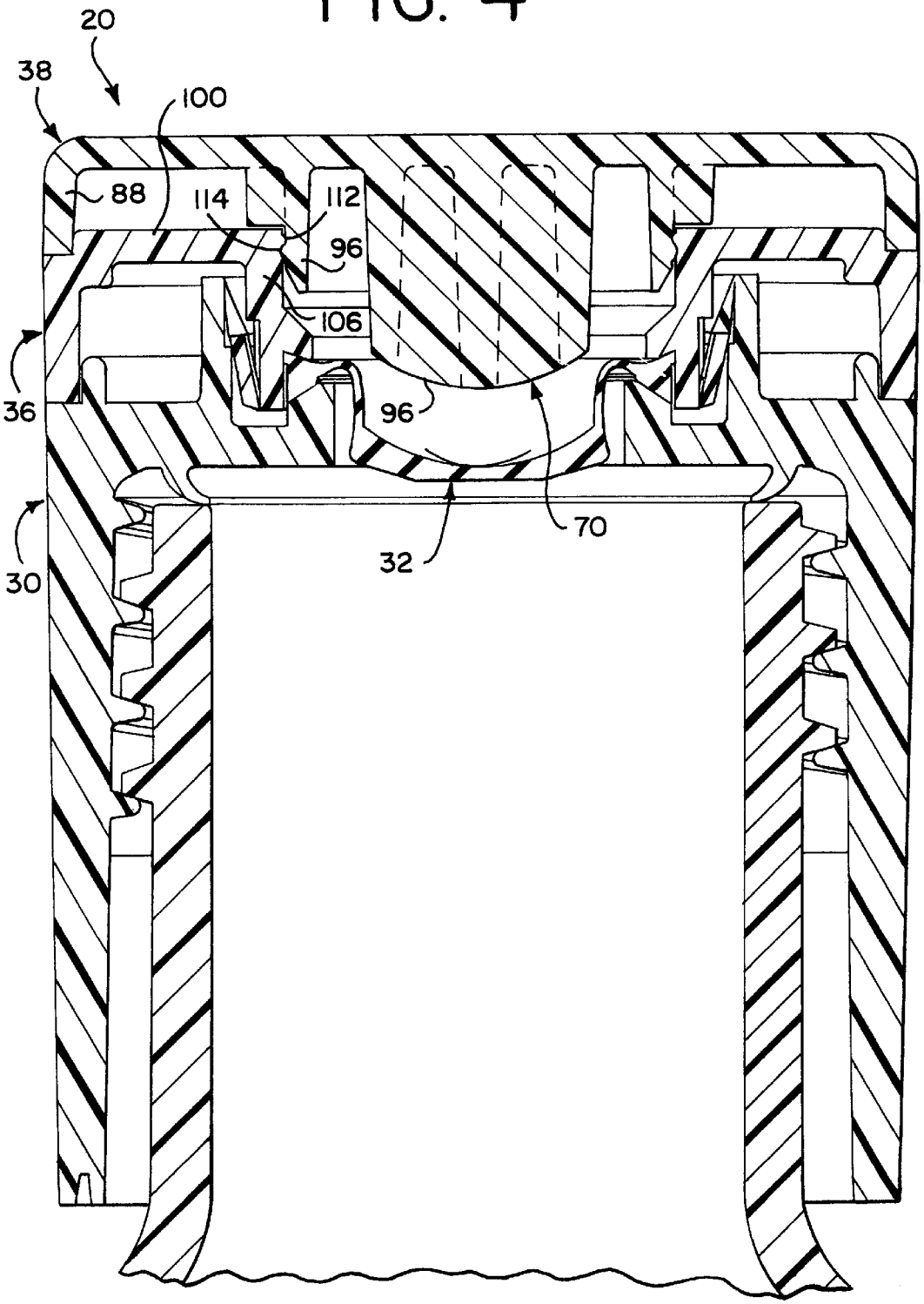
FIG. 4 is a greatly enlarged, fragmentary, cross-sectional view taken generally along the plane 4—4 in FIG. 1.

The retainer base 36 includes an upper deck 100. The upper deck 100 terminates at its periphery in a recessed shoulder 102. An outer skirt 104 extends downwardly from the shoulder 102. An inner wall 106 is defined within, and concentric with, the outer wall 104. The inner wall 106 projects downwardly from the deck 100 and defines an aperture 108 which communicates with the closure body dispensing passage 52 when the retainer 34 is mounted on the closure body 30 (as shown in FIGS. 3 and 4).

When the lid 38 is closed on the retainer base 36, the bottom of the lid skirt 88 seats on the retainer base shoulder 102 (as can be seen on the left-hand side of FIG. 3). The retainer base shoulder 102 does not extend adjacent the hinge 40, and the lid skirt 88 is shorter adjacent the hinge 40. Thus, when the lid 38 is closed (as shown in FIG. 4), the bottom of the skirt 88 adjacent the hinge 40 rests on the top of the retainer base deck 100.

When the lid 38 is closed on the retainer base 36, an interference fit is established between the lid collar 96 and the retainer base inner wall 106. In particular, with reference to FIG. 6, the retainer base inner wall 106 includes an inwardly projecting bead 112 for engaging an outwardly projecting bead 114 on the exterior surface of the lid collar 96. This provides a snap-fit engagement as shown in FIG. 3 when the lid 38 is fully seated on the retainer base 36.

The retainer base inner wall 106 includes an inwardly projecting, annular flange 120 (FIGS. 3 and 6) which has a downwardly facing, frustoconical surface defining a second seat 122. The surface or seat 122 is designed to engage the upper surface of the flange 78 of the valve 32 as shown in FIG. 3. Preferably, the angle of the seat 122 corresponds to the angle of the top of the valve flange 78.

Figure 7:
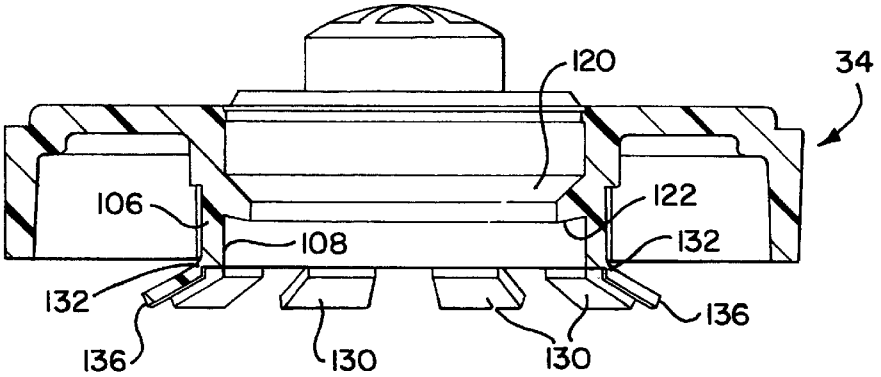
FIG. 7 is a greatly enlarged, cross-sectional view taken generally along the plane 7—7 in FIG. 5.

The retainer base inner wall 106 includes at least one engaging member 130 extending from the bottom, distal end. Preferably, there are a plurality of engaging members 130 equally spaced circumferentially around the bottom of the annular wall 106. Each engaging member 130 is connected to the wall 106 with a reduced cross-sectional thickness of material which defines a resilient hinge 132 (FIG. 7). In the as-molded condition as illustrated in FIGS. 5–6, the resilient hinge 132 has an unstressed condition to initially maintain engaging member 130 in an orientation extending outwardly away from the aperture 108. Each engaging member 130 has a generally constant, uniform thickness cross section. However, each member 130 has a width along the hinge 132 which is less than the width at the free, distal end of the member 130. The distal end of each member 130 defines an abutment surface 136. In the as-molded condition, each engaging member 130 may be characterized as having an orientation extending outwardly away from the aperture 108 at an oblique angle.

The retainer 34 can be easily assembled with the closure body 30 and valve 32 disposed thereon. Typically, the valve 32 is initially mounted on the closure body seat 68. However, the valve 32 may alternatively be initially inserted into the retainer base 36, and then the retainer base 36 (with the valve 32 carried therein and with the lid 38 closed) could then be assembled to the closure body 30.

Figure 14:
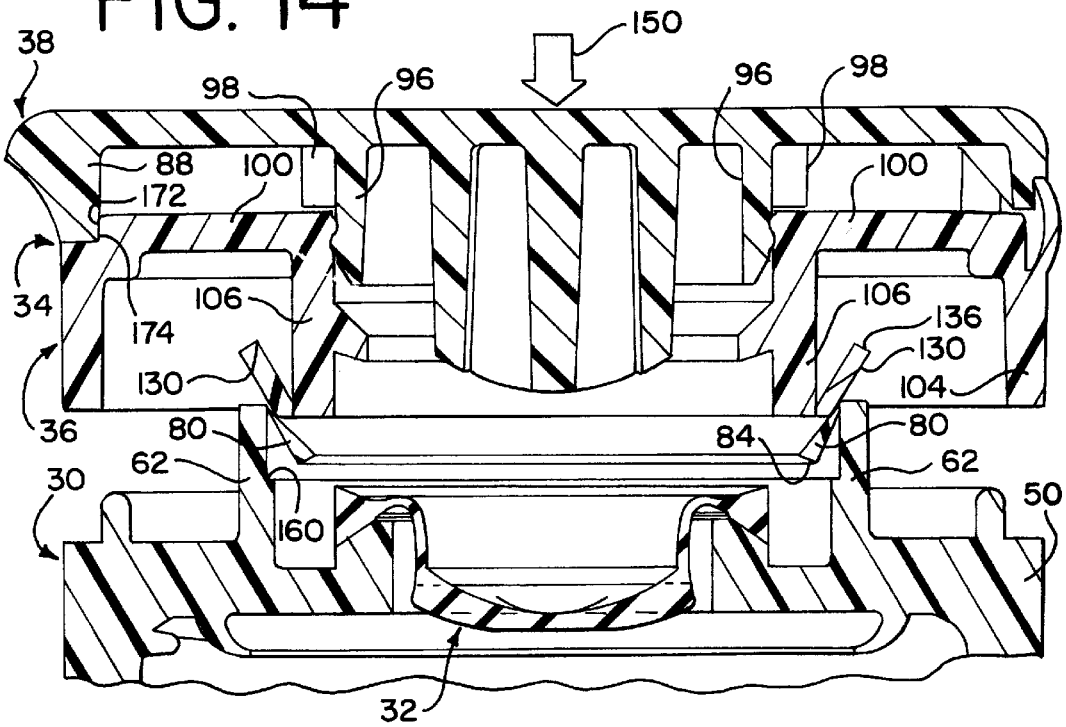
FIG. 14 is a fragmentary, cross-sectional view of the body, valve, and retainer.
Figure 15:
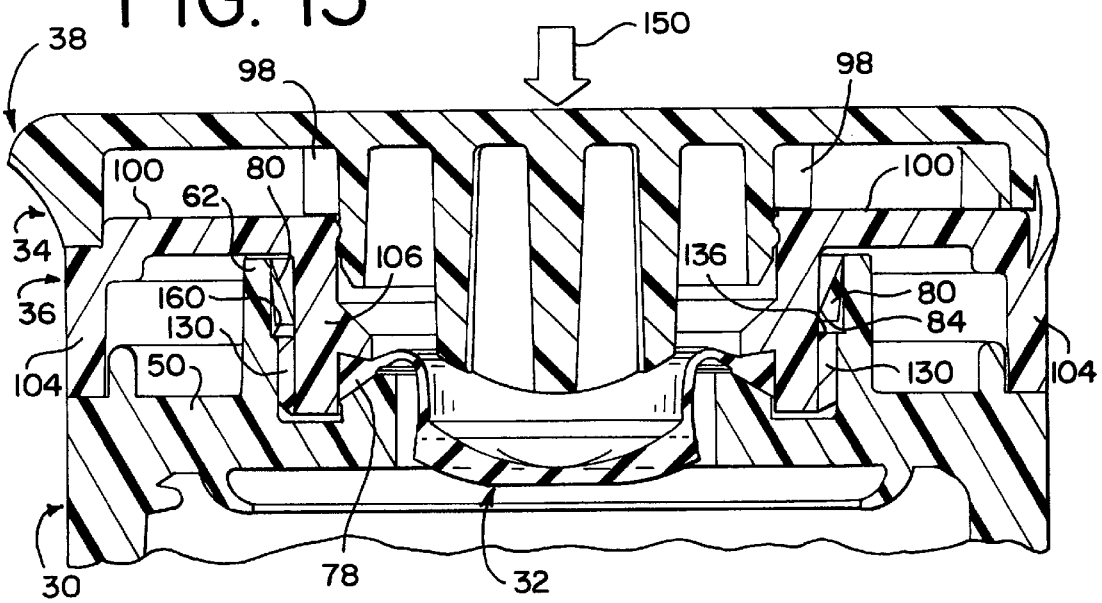
FIG. 15 is a view similar to FIG. 14, but FIG. 15 shows a later stage during the assembly process.
Figure 1:
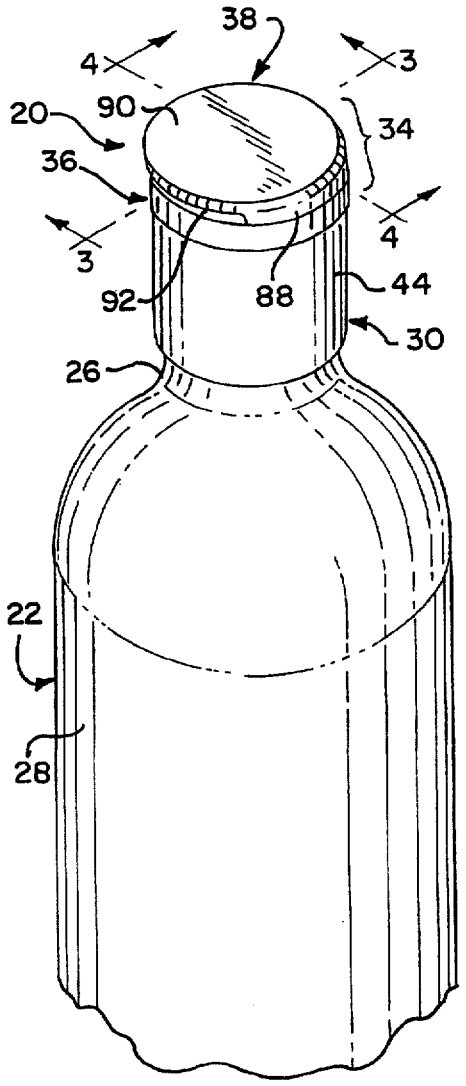
Figure 2:
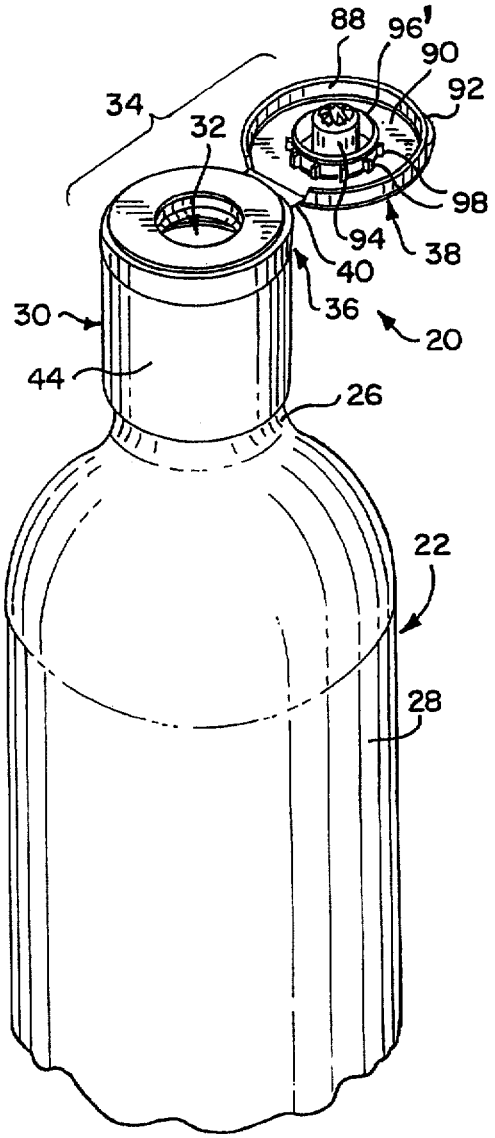
Figure 3:
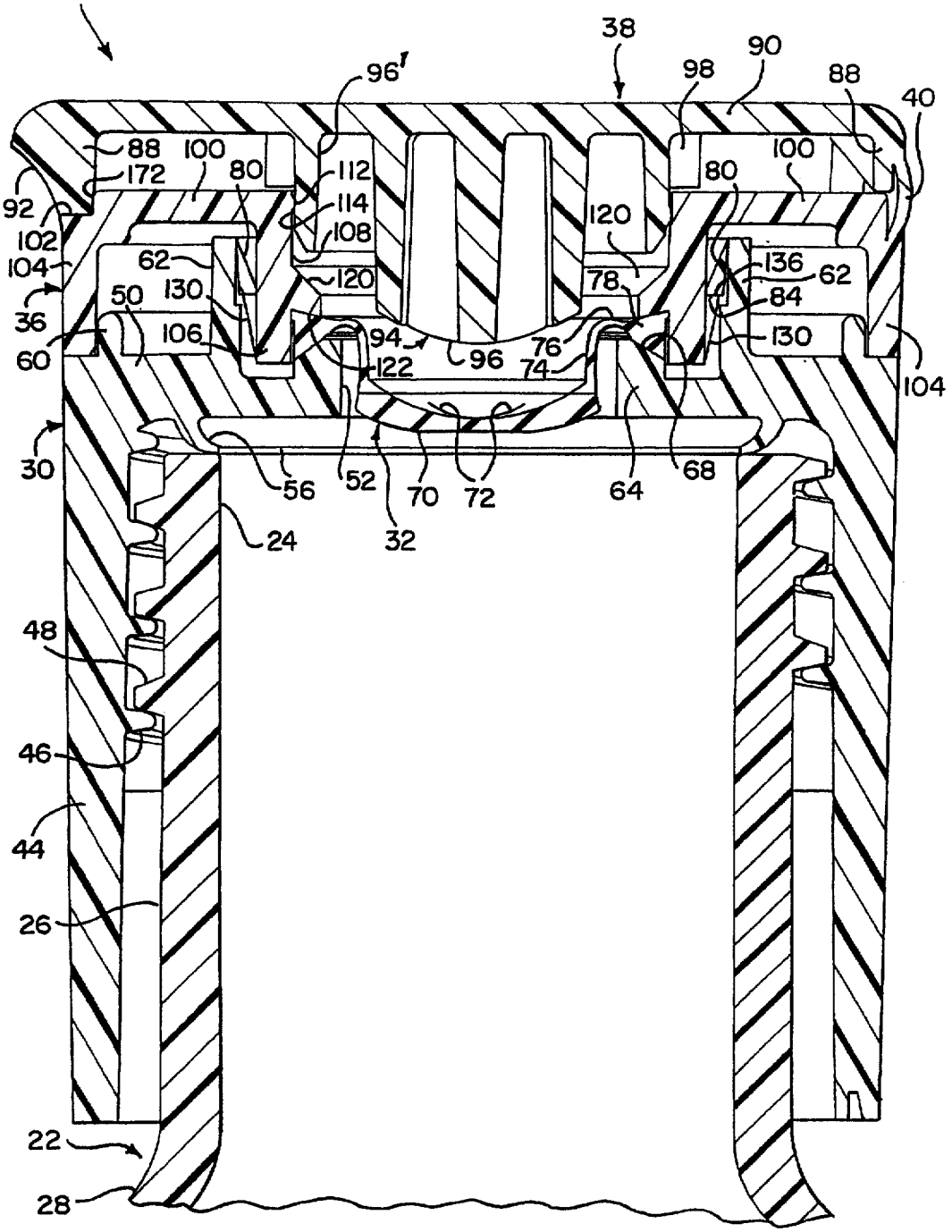
Figure 4:
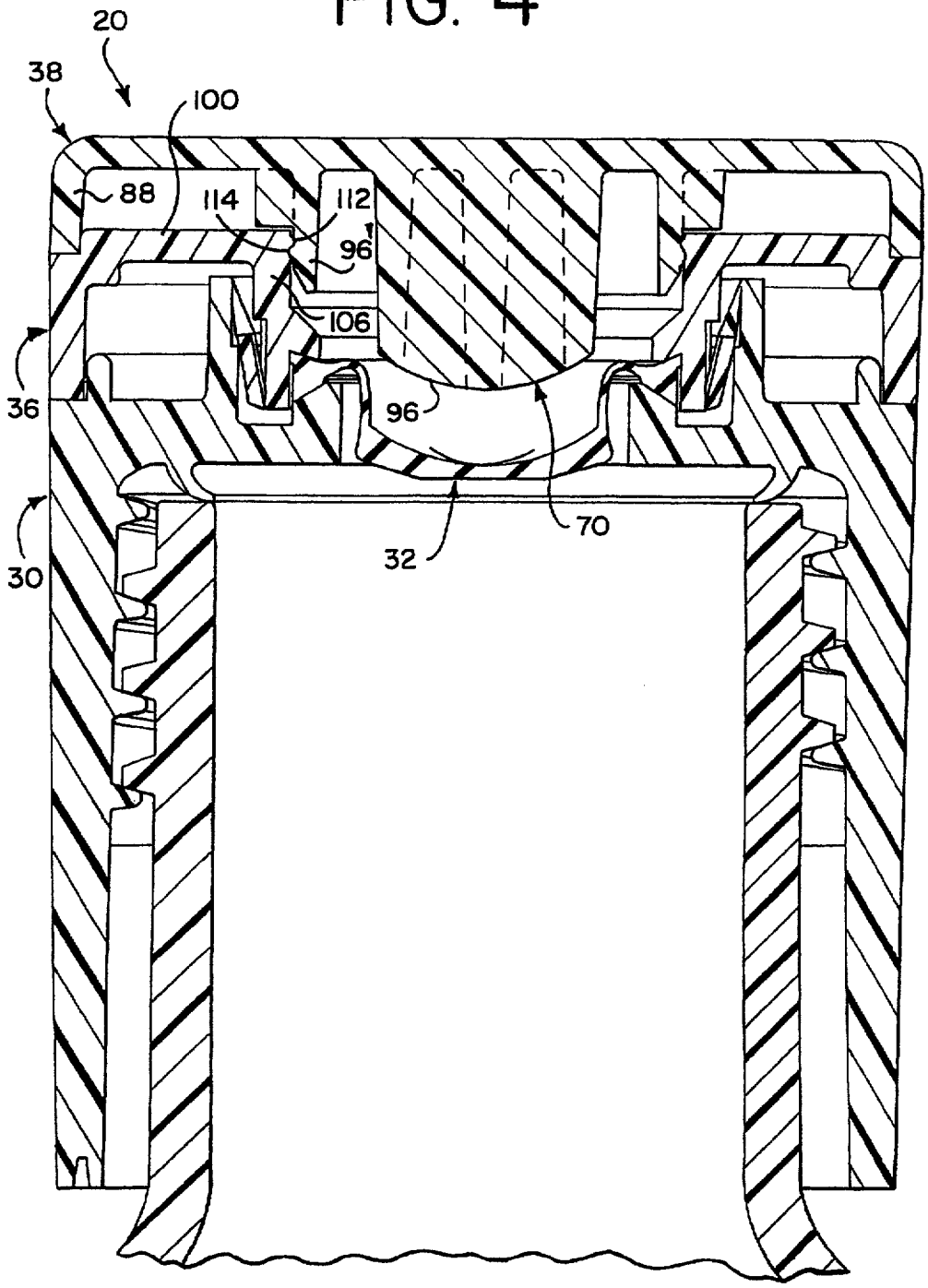
Figure 7:
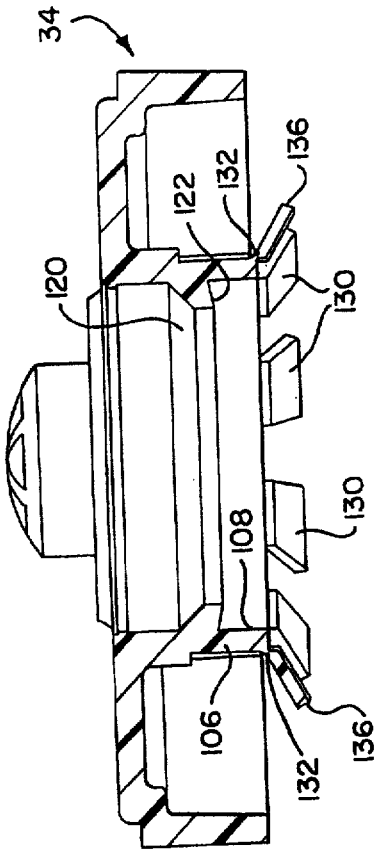
Figure 5:
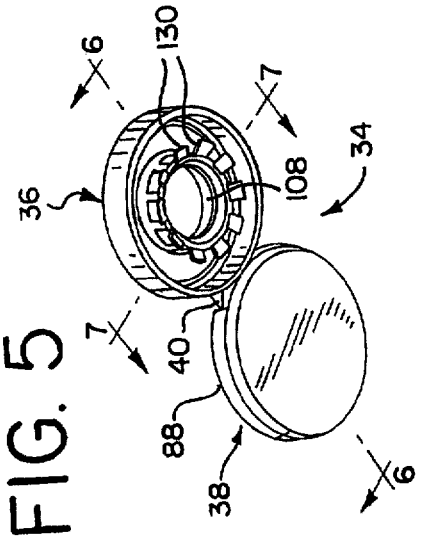
Figure 6:
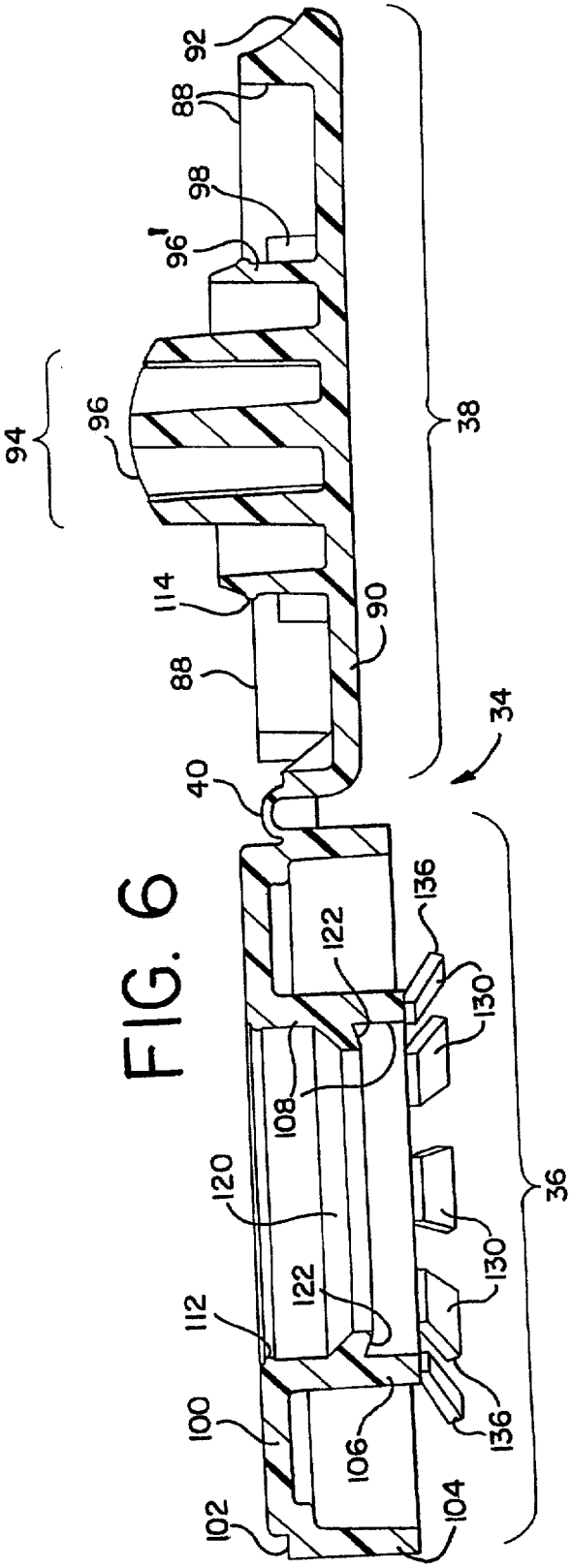
Figure 14:
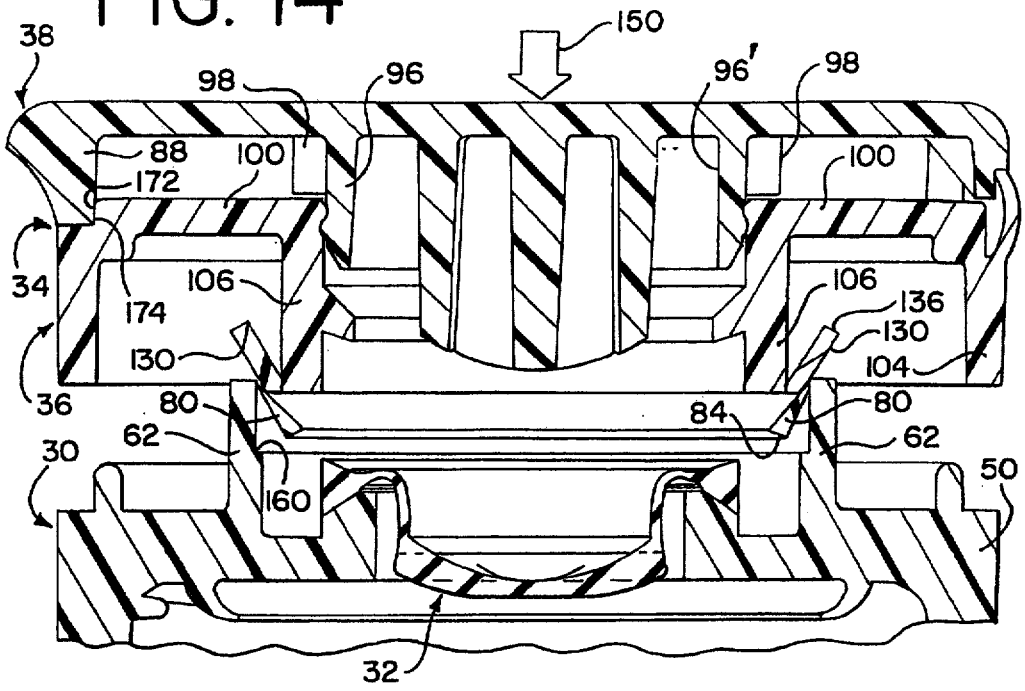
Figure 15:
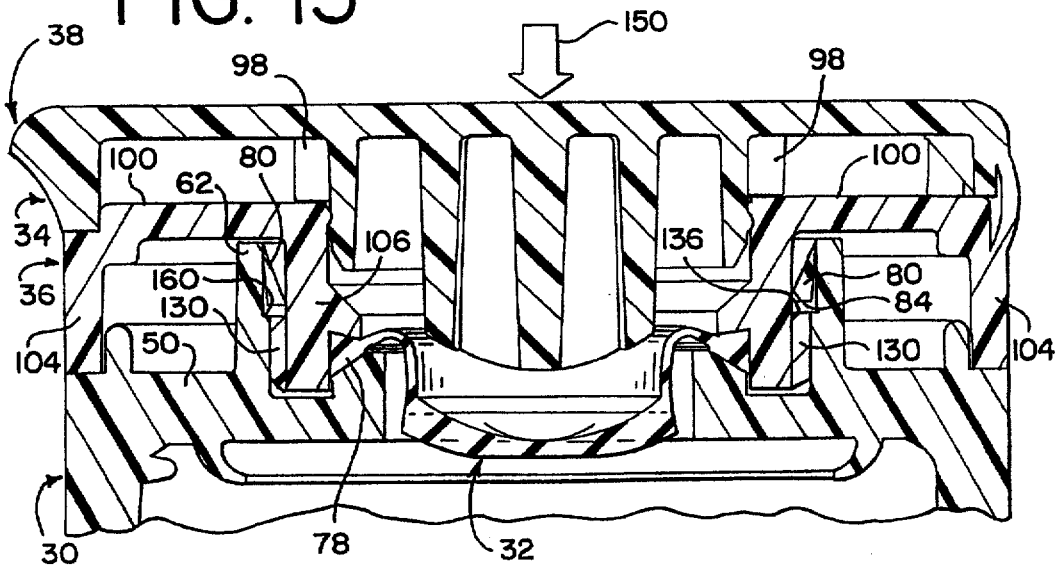

The method of assembling the components is illustrated in FIGS. 14 and 15. The retainer 34 is positioned above the closure body 30. Initially, the closure body protrusion 80 is angled upwardly as illustrated in FIG. 9, and the retainer engaging members 130 are angled downwardly as shown in FIG. 6. The retainer 34 is initially manipulated to close the lid 38 on the retainer base 36 as shown in FIG. 14.

Relative movement is then effected between the closed retainer 34 and closure body 30, typically by moving the retainer 34 downwardly, in the direction indicated by the arrow 150 in FIG. 14, toward the closure body 30. The downwardly angled engaging members 130 of the retainer initially contact the upwardly angled closure body protrusion 80. As the retainer 34 is moved further downwardly (FIG. 14), the retainer engaging members 130 are deflected upwardly and the closure body protrusion 80 is deflected downwardly.

As the retainer 34 is moved further downwardly, the retainer engaging members 130 essentially fold upwardly against the retainer annular wall 106, and the closure body protrusion 80 essentially folds downwardly against the inside of the closure body annular wall 62. To accommodate the inward folding of the protrusion 80 against the wall 62, the inner diameter of the wall 62 has a shoulder 160 (FIGS. 9 and 14) which defines a larger diameter space above the shoulder 160 and which defines a smaller diameter space below the shoulder 160. The protrusion 80 of the closure body 30 can fold into the larger diameter region above the shoulder 160 as shown in FIG. 15. The retainer engaging members 130 slide along and then beyond the folded protrusion 80 so that the retainer engaging members 130 become folded between the retainer annular wall 106 and the smaller diameter portion of the closure body wall 62 below the shoulder 160 as shown in FIG. 15.

To insure proper assembly, the system accommodates a slight amount of "over travel." As illustrated in FIG. 15, the retainer 34 can be pushed so far into the closure body 30 that the upwardly facing abutment surface 136 of each engaging member is temporarily spaced below the downwardly facing abutment surface 84. This is possible because of the resilience of the valve flange 78. The lid 38 is moved downwardly in the direction of the arrow 150 with a force sufficient to cause the valve flange 78 to compress sufficiently to initially accommodate travel of the retainer engaging member abutment surface 136 beyond and below the closure body protrusion abutment surface 84.

It will be appreciated that sufficient force can be exerted on the retainer 34 during assembly because the ribs 98 around the lid collar 96 can engage the retainer base deck 100 when the downward force causes sufficient deflection of the lid 38. Initially, when the assembly force is low, the bottom surfaces of the ribs 98 are spaced slightly above the top surface of the retainer base deck 100 as shown in FIG. 14. However, as the retainer 34 is moved further into engagement with the closure body 30, the resistance increases, and the assembly force must be increased. The increased assembly force causes the lid 38 to deflect downwardly until the bottom surfaces of the lid ribs 98 engage the top surface of the retainer base deck 100 as shown in FIG. 15. The load is then transferred fully from the top of the lid 38 to the retainer base annular wall 106 and valve flange 78. (The slight movement of the lid 38 relative to the retainer base deck 100 necessarily results in a slight, temporary disengagement of the snap-fit between the bead 114 of the lid collar 96 and the groove 112 of the retainer base annular wall 106).

The assembly force can be applied to the closed retainer 34 in the direction of the arrow 150 until the bottom of the retainer base skirt 104 engages the deck 50 of the closure body as shown in FIG. 15. This engagement limits the downward movement of the retainer skirt 104. When the assembly force is released, the highly compressed valve flange 78 expands somewhat, and the downward deflection in the system, including in the retainer base deck 100 and retainer lid 38, is no longer maintained, and the components spring back to an undeflected configuration wherein the abutment surfaces 136 of the retainer engaging members 130 engage the abutment surface 84 of the closure body protrusion 80. This final engagement position is illustrated in FIGS. 3 and 4. In this final engagement position, the valve flange 78 is still under some compression so as to provide a constant spring force or biasing force which maintains the abutment surfaces 136 of the retainer base engaging members 130 in engagement with the abutment surface 84 of the closure body protrusion 80. This engagement effectively maintains a clamping force on the valve flange 78.

The above-described method of assembly relies on the relative movement of the retainer base 34 and closure body 30 to effect engagement of the members 130 with the protrusion 80 so as to invert the members 130 and protrusion 80 generally in the orientation shown in FIG. 14. However, it is presently contemplated that it may be preferable in some manufacturing situations to "pre-invert" the members 130 and the protrusion 80 prior to bringing the retainer base 34 into engagement with the closure body 30. Specifically, it is presently contemplated that an assembly fixture, comprising a jig, punch, or other suitable mechanism, may be employed to initially engage and move the retainer base members 130 from the as-molded, downwardly angled orientation (FIG. 7) to the upwardly angled orientation (FIG. 4). Similarly, another assembly fixture, comprising a jig, punch, or other suitable device, may be employed to engage the closure body protrusion 80 and invert the protrusion 80 from the as-molded, upwardly angled orientation (FIG. 9) to the downwardly angled orientation (FIG. 14).

It will be appreciated that owing to the structure of the hinge connection of the members 130 to the retainer base 36, and owing to the hinge connection of the protrusion 80 to the closure body 30, the initial engagement with such assembly fixtures will cause each of the members 130 and the protrusion 80 to invert from its as-molded, angled orientation to the inverted, angled orientation and to remain in that inverted, angled orientation in a self-biased manner. Subsequently, after removal of the assembly fixtures from the retainer base 34 and closure body 30, the retainer base 34 (with the members 130 in the now inverted orientation) and the closure body 30 (with the protrusion 80 in the now inverted orientation) may be brought together as shown in FIG. 14 to complete the assembly process. The assembly process is completed from that point on as previously described.

The snap-fit engagement of the lid 38 with the retainer base 36 (via the retainer base bead 112 and the engaging lid bead 114 (FIGS. 3 and 4)) creates an air-tight seal. This engagement contributes to a lid-retention force keeping the lid closed. Additionally, a further lid retention force is provided by designing a small bead 172 at the front of the retainer base deck 100 to engage the inner surface of the lid skirt 88 as shown in FIGS. 3 and 14. Also, a slight protrusion or bead (not shown) may optionally be provided on the inner surface of the lid skirt 88 for establishing a snap-fit with the retainer base bead 172. The combination of the interference fit between the front of the lid 38 and the bead 172 and an interference fit between the inner beads 112 and 114 defines the total retention system for the lid and determines the amount of lifting force that is required to open the lid. The lid opening force can be adjusted by varying the size of the beads, and the interference dimensions of the lid 38 with the retainer base 36.

Figure 13:
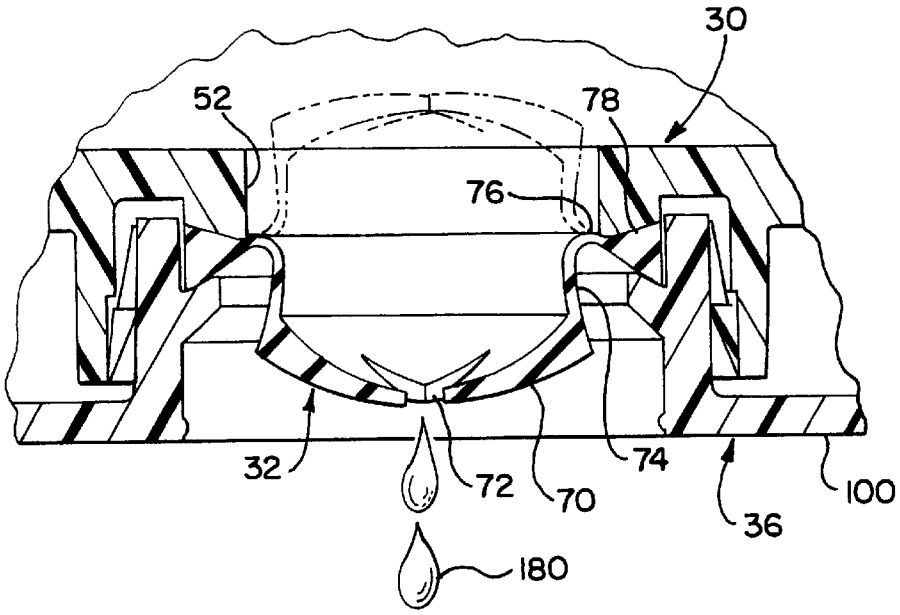
FIG. 13 is a view similar to FIG. 3, but FIG. 13 shows the container and dispensing closure in an inverted condition with the valve in an outwardly displaced position and open to dispense the product from within the container.

In use, the retainer lid 38 is first opened, and the container 22 is then typically inverted and squeezed to increase the pressure within the container 28 above the ambient exterior atmospheric pressure. This forces the product within the container toward the valve 32 and forces the valve 32 from the recessed or retracted position (illustrated in FIGS. 2, 3, and 4) toward the outwardly extending position (FIG. 13). The outward displacement of the concave, central face 70 of the valve 32 is accommodated by the relatively, thin, flexible, skirt 74. The skirt 74 moves from an inwardly projecting, rest position to an outwardly displaced, pressurized position, and this occurs by the skirt 74 "rolling" along itself outwardly toward the outside of the retainer base 36 (toward the position shown in FIG. 13). However, the valve 32 does not open (i.e., the slits 72 do not open) until the valve central face 70 has moved substantially all the way to a fully extended position adjacent or beyond the dispensing passage 52 (FIG. 13). Indeed, as the valve central wall 70 begins to move outwardly, the valve central wall 70 is initially subjected to radially inwardly directed compression forces which tend to further resist opening of the slits 72. Also, the valve central wall 70 generally retains its outwardly concave configuration as it moves outwardly and even after it reaches the fully extended position. However, when the internal pressure becomes sufficiently high after the valve central wall 70 has moved outwardly to the fully extended position, then the slits 72 of the valve 32 begin to open to dispense product (FIG. 13). The product is then expelled or discharged through the open slits 72. For illustrative purposes, FIG. 13 shows drops 180 of a liquid product being discharged.

The design of the lid 38 includes a structure for preventing discharge of the container product through the valve 32 when the lid 38 is closed and the container 22 is inadvertently squeezed or subjected to impact forces which would increase the pressure within the container.

As shown in FIG. 3, the convex distal end surface 96 of the post 94 conforms generally to the concave configuration of the outer surface of the valve central wall 70 when the lid 38 is closed. However, even when the lid 38 is closed (FIG. 3), the post distal end surface 96 is spaced outwardly from the valve central wall 70 by a small amount which accommodates an initial, small, outward displacement of the valve central wall 70 into engagement with the post distal end surface 96 before the valve slits 72 can open. Thus, when the closed container 22 is subjected to external forces which increase the container internal pressure, the valve central wall 70 is forced outwardly against the conforming end surface 96 of the seal post 94. The engagement between the closed lid seal post 94 and the outwardly moving valve central wall 70 occurs inwardly of the position at which the valve slits 72 would first start to open.

Further, in some applications, it may be desirable to provide yet a further valve sealing effect in overpressure conditions. Specifically, as the valve central wall 70 moves outwardly, the diameter of the periphery of the valve central wall 70 and of the valve skirt 74 may tend to become slightly reduced or compressed in the radially inwardly direction to accommodate the axially outward movement of the valve central wall 70. The slight reduction in the diameters of portions of the valve 32 may be characterized as somewhat of a "collapsing" motion which can occur around the distal end of the lid seal post 94 and which further facilitates the sealing of the valve 32 by the lid seal post 94.

The side surface of the lid seal post 94 is smooth and free of indentations or other structure which could collect unwanted product, and the smooth side surface of the seal post 94 provides a sealing surface for engagement with the valve 32. The sealing engagement between the seal post 94 and the valve 32 serves to provide a seal which prevents unwanted dispensing of product into the lid region of the closure.

An additional relationship helps to keep the valve slits 72 closed when the lid 38 is closed. Specifically, as the valve central wall 70 articulates or moves outwardly from the fully recessed position (FIG. 3) toward a more outwardly displaced position adjacent the lid seal post 94, air between the sealed closed lid 38 and valve 32 is compressed, and this resists further movement of the valve central wall 70 outwardly toward the open position.

The dispensing structure of the present invention allows the valve receiver or receiving seat region of the closure to be designed as an integrally molded part of the closure body 30. The design of the valve retainer 34 readily accommodates the molding of the lid 38 as a unitary or integral part of the retainer 34 by providing a molded hinge 40 connecting the retainer base 36 with the retainer lid 38. This allows the retainer 34, with the lid 38 in the closed condition, to be molded and stored in bulk quantities prior to assembly on closure bodies 30.

The lid portion of the retainer 34 can be constructed as a standard lid design. The retainer base 36 may also be constructed as a standard design, and the upper end portion of the closure body 30 may be constructed as a standard design for receiving the standard retainer base 36. The internal, lower portion of the closure body 30, including the skirt 44 and threads, if any, are the only portion of the closure that need be specifically sized for particular container. Thus, the closure retainer 34 may be made in a single, standard mold cavity. Only a portion of the mold cavity for the closure body 30 need be different for different containers.

In the preferred embodiment illustrated in FIGS. 8 and 9, the closure body protrusion 80 is a single, unitary structure. It will be appreciated, however, that the protrusion 80 may be provided as a plurality of outwardly projecting, spaced-apart segments, similar to the arrangement of the individual retainer engaging members 130 (FIGS. 5–6).

It will be readily observed from the foregoing detailed description of the invention and from the illustrations thereof that numerous other variations and modifications may be effected without departing from the true spirit and scope of the novel concepts or principles of this invention.

What is claimed is:

1. A system for holding a dispensing valve that has a peripheral, resilient mounting flange with first and second sides and that is operable to discharge the contents from the interior of a container, said system comprising:

a body for extending from said container, said body defining a dispensing passage for establishing communication between said container interior and the exterior of said container, said body having a first seat around said dispensing passage for engaging said first side of said valve mounting flange, said body having a body wall around said first seat, said body having a protrusion that has a distal end defining an abutment surface and that is connected to said body wall with a resilient hinge having an unstressed condition to initially maintain said protrusion in an orientation extending relative to said dispensing passage at an oblique angle; and a retainer for mounting to said body, said retainer defining an aperture for communicating with said body dispensing passage, said retainer having a second seat around said aperture for engaging said second side of said valve mounting flange, said retainer having a retainer wall around said second seat, said retainer having an engaging member that has a distal end defining an abutment surface and that is connected to said retainer wall with a resilient hinge having an unstressed condition to initially maintain said engaging member in an orientation extending outwardly away from said aperture at an oblique angle whereby when said valve is disposed so that said valve mounting flange is between said first and second seats, relative movement can be effected between said retainer and body to (1) engage said protrusion with said engaging member for deflecting said protrusion and said engaging member toward said body wall and said retainer wall, respectively, (2) effect relative movement of said protrusion and said engaging member past each other to establish abutting engagement of said protrusion abutment surface with said engaging member abutment surface, and (3) clamp said valve mounting flange between said first and second seats.

2. The system in accordance with claim 1 in which said first seat is defined by a frustoconical surface.

3. The system in accordance with claim 1 in which said second seat is defined by a frustoconical surface.

4. The system in accordance with claim 1 in which said retainer includes a base defining (1) said aperture, (2) said second seat, and (3) said engaging member; and said engaging member is one of a plurality of identical engaging members circumferentially spaced in a generally circular array around said base.

5. The system in accordance with claim 1 in which said protrusion has a cross-sectional configuration along its length that is narrower at the hinge connecting the protrusion to said closure body wall and is thicker at said abutment surface.

6. The system in accordance with claim 1 in which said retainer includes a base defining (1) said aperture, (2) said second seat, and (3) said retainer wall; and said retainer further includes a lid and a hinge connecting said lid to said retainer base.

7. The system in accordance with claim 6 in which said lid includes at least one inwardly projecting rib for engaging said base when said lid is closed and deflected as said closed lid is pushed to force said retainer into engagement with said closure body.

8. The system in accordance with claim 6 in which said lid includes an inwardly projecting post and an inwardly projecting collar surrounding said post.

9. The system in accordance with claim 6 in which said lid collar includes an outwardly projecting bead; and said retainer base annular wall defines an inwardly projecting bead for effecting a snap-fit engagement with said lid collar outwardly projecting bead when said lid is closed.

10. The system in accordance with claim 1 in which said closure body wall around said first seat defines an upper inner diameter and a lower inner diameter separated by an annular shoulder; and said upper diameter is larger than said lower diameter.

11. The system in accordance with claim 1 in which said retainer wall is adapted to be received within said closure body wall.

12. A system for holding a dispensing valve that has a peripheral mounting flange and that is operable to discharge the contents from the interior of a container, said system comprising:

a body for extending from said container, said body having a first seat for engaging part of said valve mounting flange, said body having a resilient hinge and a protrusion that (1) extends from said hinge, and (2) has an abutment surface;

a retainer for mounting to said body, said retainer having a second seat for engaging part of said valve mounting flange, said retainer having a resilient hinge and an engaging member that (1) extends from said retainer hinge, and (2) has an abutment surface; and said hinges accommodating deflection of said protrusion and said engaging member as said protrusion and said engaging member move past each other and establish abutting engagement of said protrusion abutment surface with said engaging member abutment surface when relative movement is effected between said body and retainer so as to clamp said valve mounting flange between said body first seat and said retainer second seat.

13. The system in accordance with claim 12 in which said closure body has an annular wall around said first seat.

14. The system in accordance with claim 12 in which said retainer has a retainer wall around said second seat.

15. The system in accordance with claim 12 in which said body protrusion is thinner at said hinge and thicker at said abutment surface.

16. The system in accordance with claim 12 in which said engaging member is one of a plurality of circumferentially spaced, identical engaging members.

* * * * *

UNITED STATES PATENT AND TRADEMARK OFFICE

CERTIFICATE OF CORRECTION

PATENT NO. : 5,971,232

DATED : October 26, 1999

INVENTOR(S) : Robert D. Rohr, Milton R. Dallas, Jr., Thomas P. Kasting

It is certified that error appears in the above-identified patent and that said Letters Patent is hereby corrected as shown below:

The title page showing the illustrative Figure should be deleted to be replaced with the attached title page.

In the drawings, sheets 1, 2, 3, 4 and 7, consisting of FIGS. 2, 3, 4, 6 and 14, the collar reference number "96" should be --96'--, as shown on the attached pages.

Column 6, line 54, "96" should be --96'--.
Column 7, line 7, "96" should be --96'--.
Column 7, line 12, "96" should be --96'--.

Signed and Sealed this

Sixteenth Day of May, 2000

*Attest:*

Q. TODD DICKINSON

*Attesting Officer*

*Director of Patents and Trademarks*

United States Patent [19]

Rohr et al.

[11] Patent Number: 5,971,232

[45] Date of Patent: Oct. 26, 1999

[54] DISPENSING STRUCTURE WHICH HAS A PRESSURE-OPENABLE VALVE RETAINED WITH FOLDING ELEMENTS

[75] Inventors: Robert D. Rohr, Eagle; Milton R. Dallas, Jr., East Troy; Thomas P. Kasting, Eagle, all of Wis.

[73] Assignee: AptarGroup, Inc., Crystal Lake, Ill.

[21] Appl. No.: 09/089,573

[22] Filed: Jun. 3, 1998

[51] Int. Cl.[6] ..... B65D 5/72; B65D 43/16; B65D 39/00

[52] U.S. Cl. ..... 222/494; 222/213; 222/490; 220/259; 215/294

[58] Field of Search ..... 222/490, 494, 222/212, 213; 220/259; 215/294, 306

[56] References Cited

U.S. PATENT DOCUMENTS

| | | | |
|---|---|---|---|
| 3,279,643 | 10/1966 | Amesbury et al. | 220/24.5 |
| 3,337,900 | 8/1967 | Schwartzman . | |
| 3,578,203 | 5/1971 | Mainet | 220/46 |
| 3,877,598 | 4/1975 | Hazard . | |
| 3,981,419 | 9/1976 | Nilson . | |
| 4,010,875 | 3/1977 | Babiol . | |
| 4,185,747 | 1/1980 | Goncalves . | |
| 4,231,486 | 11/1980 | Bock . | |
| 4,420,101 | 12/1983 | O'Neill . | |
| 4,506,809 | 3/1985 | Corsette . | |
| 4,519,513 | 5/1985 | Weiler et al. . | |
| 4,722,449 | 2/1988 | Dubach . | |
| 4,739,906 | 4/1988 | LoTurco . | |
| 4,746,025 | 5/1988 | Krautkrämer et al. . | |
| 4,779,764 | 10/1988 | Debetencourt . | |
| 4,785,978 | 11/1988 | Kano et al. . | |
| 4,793,501 | 12/1988 | Beck . | |
| 4,796,769 | 1/1989 | Obadia . | |
| 4,807,769 | 2/1989 | Gach . | |
| 4,811,856 | 3/1989 | Fischman . | |
| 4,813,577 | 3/1989 | Carow . | |
| 4,848,612 | 7/1989 | Beck . | |
| 4,917,271 | 4/1990 | Kanner et al. . | |
| 4,941,580 | 7/1990 | Julian . | |
| 4,941,598 | 7/1990 | Lambelet, Jr. et al. . | |
| 4,991,745 | 2/1991 | Brown . | |
| 4,993,577 | 2/1991 | Griffin et al. . | |
| 4,993,606 | 2/1991 | Bolen et al. . | |
| 5,005,737 | 4/1991 | Rohr . | |
| 5,033,647 | 7/1991 | Smith et al. . | |
| 5,048,750 | 9/1991 | Tobler . | |
| 5,094,361 | 3/1992 | Dubach . | |

(List continued on next page.)

*Primary Examiner*—Andres Kashnikow
*Assistant Examiner*—Keats Quinalty
*Attorney, Agent, or Firm*—Rockey, Milnamow & Katz, Ltd.

[57] ABSTRACT

A system is provided for holding a dispensing valve that has a peripheral mounting flange and that is operable to discharge the contents from the interior of a container. The system includes a body for extending from the container. The body has a seat for engaging part of the valve mounting flange. The body has a resilient hinge and a protrusion that (1) extends from the hinge, and (2) has an abutment surface. The system includes a retainer for mounting to the body. The retainer has a seat for engaging part of the valve mounting flange. The retainer has a resilient hinge and an engaging member that (1) extends from the retainer hinge, and (2) has an abutment surface. The hinges accommodate deflection of the protrusion and engaging member as the protrusion and engaging member move past each other and establish abutting engagement of the protrusion abutment surface with the engaging member abutment surface as relative movement is effected between the body and retainer so as to clamp the valve mounting flange between the body seat and retainer seat.

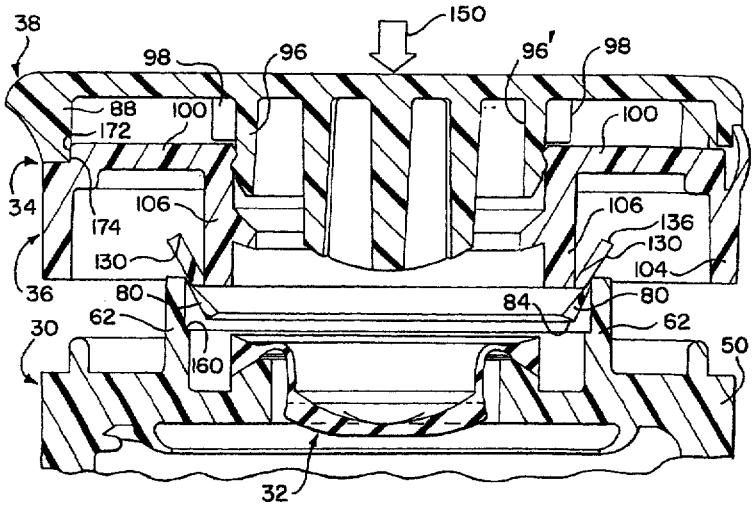

16 Claims, 7 Drawing Sheets